US006460620B1

(12) United States Patent
LaFleur

(10) Patent No.: US 6,460,620 B1
(45) Date of Patent: Oct. 8, 2002

(54) MUDSAVER VALVE

(75) Inventor: Karl K. LaFleur, Weatherford, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/451,185

(22) Filed: Nov. 29, 1999

(51) Int. Cl.[7] ..... E21B 34/02; E21B 34/08

(52) U.S. Cl. ..... 166/324; 137/881; 166/321; 175/218; 175/317

(58) Field of Search ..... 137/496, 853, 137/877, 881; 166/321, 324, 325, 326; 175/218, 317

(56) References Cited

U.S. PATENT DOCUMENTS

| | | | | | |
|---|---|---|---|---|---|
| 1,854,518 | A | * | 4/1932 | Little | 137/853 X |
| 2,275,937 | A | * | 3/1942 | Baker | 137/853 X |
| 2,746,721 | A | * | 5/1956 | Moore | 175/317 |
| 3,025,919 | A | * | 3/1962 | Angel et al. | 175/317 |
| 3,276,523 | A | * | 10/1966 | Oliver | 166/326 X |
| 3,363,696 | A | | 1/1968 | Berryman | |
| 3,537,518 | A | * | 11/1970 | Sullivan et al. | 166/325 X |
| 3,967,679 | A | | 7/1976 | Liljestrand | |
| 4,192,378 | A | | 3/1980 | Baker et al. | 166/186 |
| 4,249,611 | A | | 2/1981 | Zijlstra | 166/367 |
| 4,625,755 | A | * | 12/1986 | Reddoch | 166/325 X |
| 4,955,949 | A | * | 9/1990 | Bailey et al. | 166/325 X |
| 4,962,819 | A | | 10/1990 | Bailey et al. | |
| 4,997,042 | A | | 3/1991 | Jordan et al. | |
| 5,152,554 | A | | 10/1992 | LaFleur et al. | |
| 5,165,493 | A | * | 11/1992 | Baugh | 175/218 |
| 5,191,939 | A | | 3/1993 | Stokley | |
| 5,282,653 | A | | 2/1994 | LaFleur et al. | |
| 5,348,351 | A | | 9/1994 | LaFleur et al. | 285/110 |
| 5,355,959 | A | | 10/1994 | Walter et al. | |
| 5,479,988 | A | * | 1/1996 | Appleton | 166/325 |
| 5,501,280 | A | | 3/1996 | Brisco | |
| 5,584,343 | A | | 12/1996 | Coone | |
| 5,735,348 | A | | 4/1998 | Hawkins, III | |
| 5,918,673 | A | | 7/1999 | Hawkins et al. | |
| 5,971,079 | A | | 10/1999 | Mullins | |
| 6,053,191 | A | * | 4/2000 | Hussey | 175/218 X |

* cited by examiner

*Primary Examiner*—George Suchfield
(74) *Attorney, Agent, or Firm*—Moser, Patterson & Sheridan, L.L.P.

(57) ABSTRACT

A mudsaver valve for use in well drilling operations includes an elongated tubular main body supporting a tubular mandrel-like mudsaver closure member therein for movement between valve open and closed positions. A coil spring is disposed in the main body member and is engageable with the mudsaver closure member to bias the mudsaver closure member in a valve closed position. The mudsaver closure member includes an axial passage formed therein and ports opening from the axial passage to the exterior of the mudsaver closure member. The mudsaver closure member is engageable with an annular resilient packoff element and is pressure biased to move to an open position wherein the ports pass through the annular packoff element to allow fluid to flow through the valve. A flowback valve is integrated with the mudsaver valve and comprises an annular resistant duckbill type closure member mounted in a second body member attached to the main body member and responsive to pressure fluid in a casing in which the mudsaver valve is disposed to equalize fluid pressure between the interior of the casing or similar conduit and a supply conduit connected to the mudsaver valve.

29 Claims, 4 Drawing Sheets

MUDSAVER VALVE

FIELD OF THE INVENTION

The present invention pertains to a mudsaver valve and flowback valve assembly for use in well drilling and casing installation operations.

BACKGROUND

In the art of well drilling operations, including operations to install well casing, it is common practice to fill the tubular drillstem or casing with drill cuttings evacuation fluid and circulate such drilling fluid or so-called "mud" through the drillstem or casing and the wellbore. In this regard, so-called mudsaver valves are usually connected to the lower end of the hollow drillstem drive member or kelly or to the lower end of a so-called circulating head to prevent spillage of fluid or "mud" when the kelly or circulating head are disconnected from the drillstem or casing, as the case may be. The use of a mudsaver valve is desirable to prevent the aforementioned loss of "drilling" fluid, to prevent unsafe operating conditions for personnel and also to minimize contamination of the environment in the vicinity of the drilling operation.

Prior art mudsaver valves are characterized, generally, by a poppet type closure member which is held against a valve seat by a spring. However, in many instances, solid particulates are distributed throughout the drilling fluid, such as lost circulation material, which become trapped between the valve closure member and the valve seat resulting in the mudsaver valve not closing completely, and thus the loss of drilling fluid out of the circulating head or conduits which supply the fluid during operations.

Another problem associated with operations which include the use of prior art mudsaver valves pertains to the inability to at least reliably equalize the pressure between the casing or drillstem interior passage and the conduit to which the mudsaver valve is connected. Fluid pressure in the so-called standpipe or conduit to which the mudsaver valve is connected for supplying fluid to the drillstem or casing should be reduced to substantially the same pressure as the fluid in the drillstem or casing at the upper end thereof prior to disconnection and withdrawal of the circulating head and mudsaver valve from the casing. If fluid pressure should increase in the casing beyond a reasonable value which would permit disconnection of the circulating head from the casing this pressure can be monitored by suitable instruments connected to the fluid supply conduit or standpipe connected to the circulating head. Accordingly, the mud saver valve should be operable to substantially equalize the fluid pressure in the drillstem or casing with that in the standpipe or other fluid supply conduit before disconnecting the fluid circulating head or casing installation equipment from the drillstem or casing.

The above-mentioned problems associated with prior art mudsaver valves and operations which utilize mudsaver valves together with other improvements which have been desired in mudsaver valves have been substantially met by the present invention.

SUMMARY OF THE INVENTION

The present invention provides an improved mudsaver valve for use in well drilling and casing installation operations. The present invention also provides an improved mudsaver valve and flowback valve assembly.

In accordance with one important aspect of the present invention a mudsaver valve is provided which is characterized by an elongated tubular mandrel shaped closure member which is slidably disposed in a generally cylindrical valve body and is spring biased to a valve closed position, but responds to a pressure differential acting thereacross to move to a valve open position. The chance of improper valve closure is minimized by the configuration of the tubular valve closure member which is provided with lateral or radially extending ports and wherein the tubular closure member is disposed in engagement with a cylindrical annular seal or packoff member. The annular seal or packoff member functions as a seal or valve "seat", is mounted in the mudsaver valve body, is operable to sealingly engage the closure member and is operable to minimize damage to the closure member or the packoff member when particulate laden fluid is being pumped through the mudsaver valve.

In accordance with another aspect of the present invention an improved mudsaver valve is provided in combination with a flowback valve which is operable to equalize fluid pressure between a tubular casing or drillstem member in which the mudsaver valve is disposed and a fluid supply conduit to which the mudsaver valve is connected. The flowback valve itself is of novel configuration and is also operable to prevent recirculation of fluid through the flowback valve when fluid is being purposely pumped through the mudsaver valve and into a casing, drillstem or the like. Still further, the flowback valve is configured to minimize damage to itself or loss of its sealing or shutoff function when exposed to particulate laden fluids.

Still further, the present invention provides an improved mudsaver valve and flowback valve assembly which requires a minimum number of uncomplicated, rugged and reliable parts which may be easily replaced, if required. The mudsaver and flowback valve assembly is configured to be reliable and long lived in operation by providing the valve assembly with wear members which can be easily replaced without requiring replacement of major valve components.

Those skilled in the art will further appreciate the above-mentioned advantages and superior features of the invention together with other important aspects thereof upon reading the detailed description which follows in conjunction with the drawing.

DETAILED DESCRIPTION OF A PREFERRED EMBODIMENT

Figure 1:
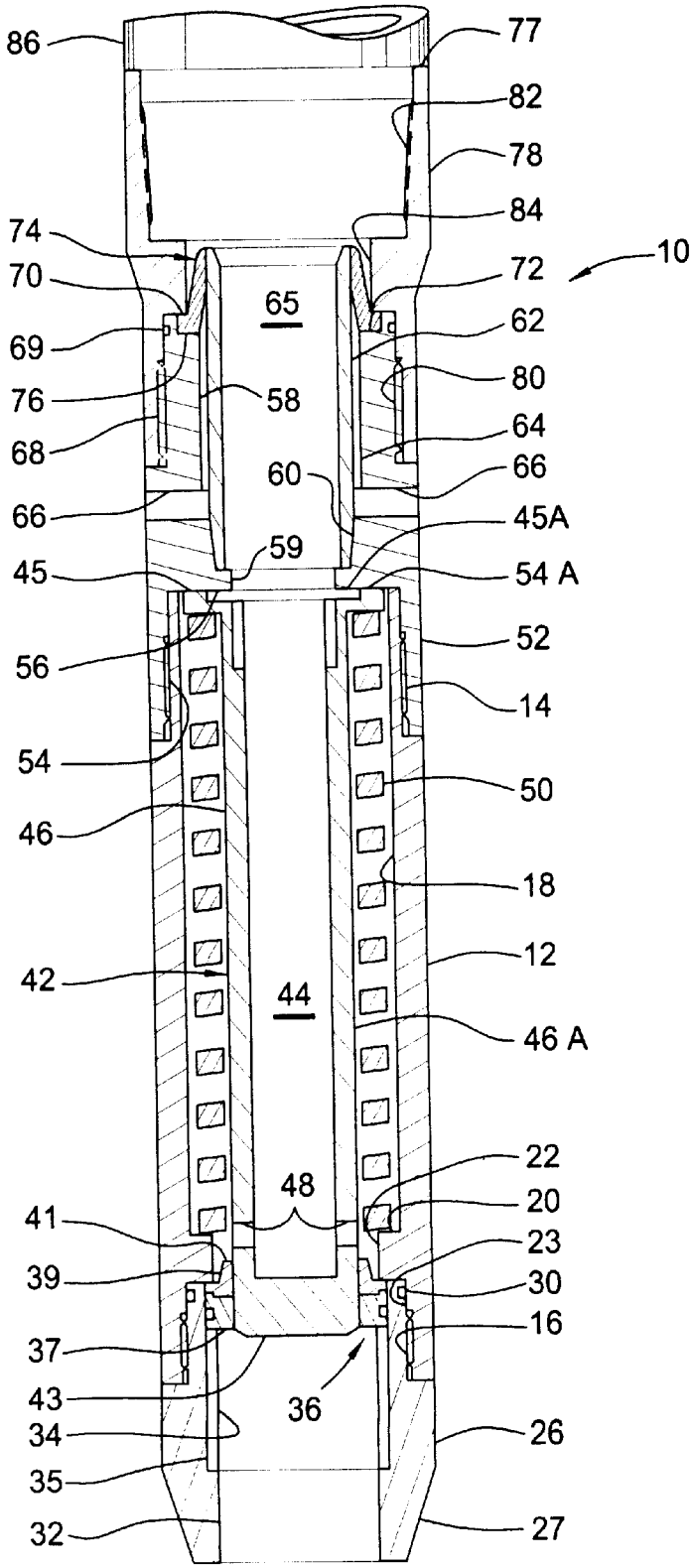
FIG. 1 is a longitudinal central section view of a mudsaver valve and flowback valve assembly in accordance with the present invention.

In the description which follows like parts are marked throughout the specification and drawing with the same reference numerals, respectively. The drawing figures are not necessarily to scale and certain elements may be shown in schematic or somewhat generalized form in the interest of clarity and conciseness.

Figure 2:
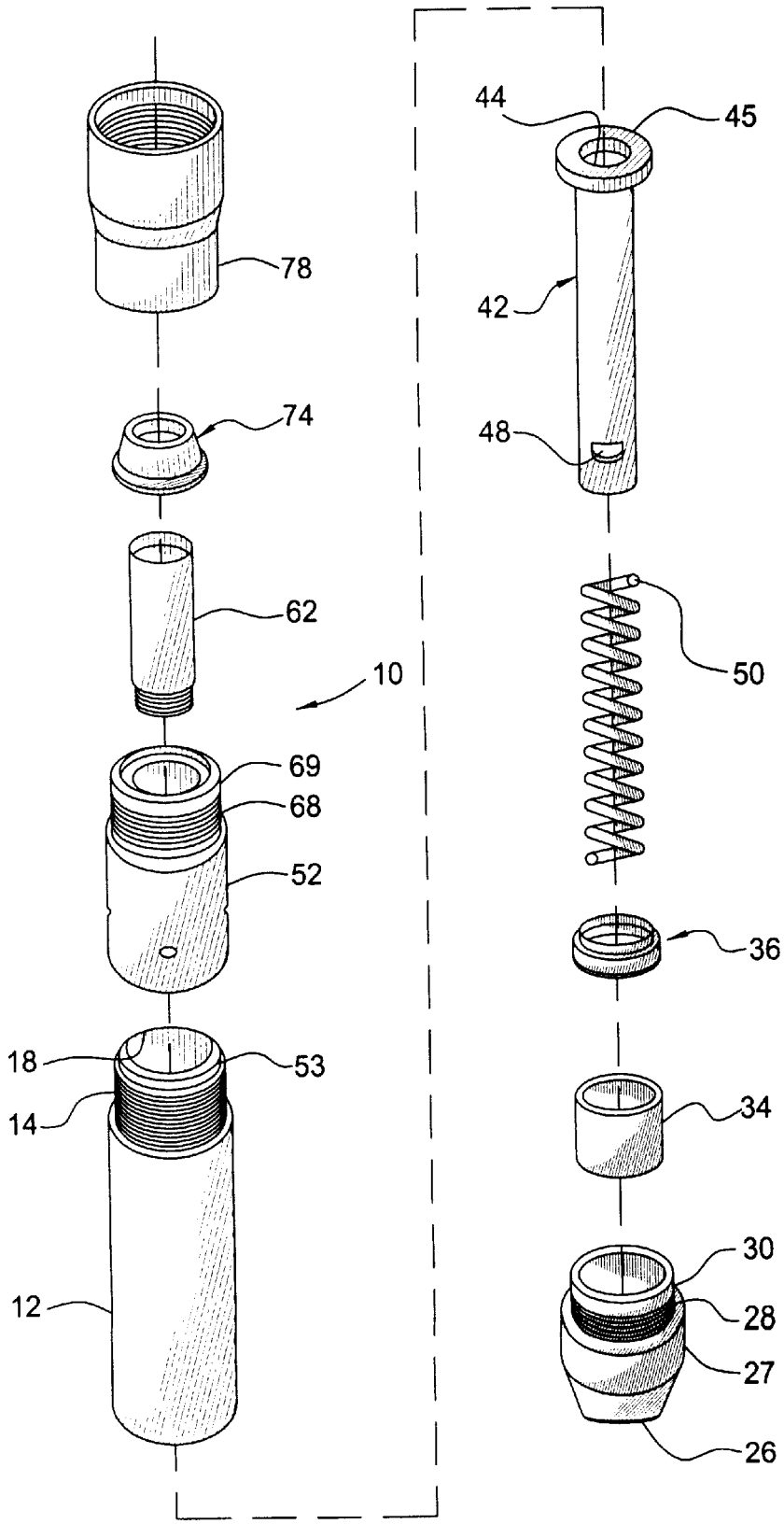
FIG. 2 is an exploded perspective view of the parts of the valve assembly shown in FIG. 1.

Referring to FIGS. 1 and 2, there is illustrated and improved mudsaver valve and flowback valve assembly in accordance with the present invention and generally designated by the numeral 10. The valve assembly 10 is characterized by an elongated tubular main body member 12 having an externally threaded portion 14 at an upper end and an internally threaded portion 16, FIG. 1, at its lower end. A relatively large diameter cylindrical bore 18 extends over a major portion of the length of the body member 12 and terminates at an annular shoulder 20 which is also delimited by a reduced diameter bore 22, FIG. 1. Annular shoulder 20 is further delimited by a lower cylindrical bore 23 portion forming a seal bore and extending downward to the threaded portion 16.

A generally cylindrical tubular body member or so-called guide nose 26 is threadedly connected to the lower end of the body member 12 at cooperating external threads 28. A suitable annular seal, such as an o-ring 30, is disposed in an annular groove at the threads 28 and is adapted to sealingly engage the body 12 at the bore 23, FIG. 1. The lower body member or guide nose 26 has an axially tapered distal end portion 27 to assist in guiding the valve assembly 10 into a conduit or the like. A central axial bore 32, FIG. 1, is formed in body member or nose 26. An annular hard metal replaceable wear sleeve 34 is disposed in a bore 35 formed in the body member or nose 26, also as shown in FIG. 1. A two-part, annular, resilient seal or packoff assembly 36 is retained in the nose 26 between the wear sleeve 34 and the shoulder 20 when the body member 12 is assembled to the body member or guide nose 26, also as shown in FIG. 1. The seal or packoff assembly 36 is preferably formed of a first annular member 37 comprising a material such as steel and a second annular member 39 formed of a material such as rubber and including a frustoconical lip portion 41. Both members 37 and 39 are in substantially fluid-tight sealing, but relatively slidable engagement with an elongated tubular mandrel-like valve closure member 42 which has a closed lower distal end 43 and an elongated axially extending passage 44 formed therein. Passage 44 opens to the upper or opposite end 45 of the closure member 42 which end is formed as a circumferential annular flange having an outer diameter greater than the diameter of an elongated tubular body portion 46 of the closure member 42.

Spaced a short distance from the lower distal end 43 of the closure member 42 are plural circumferentially spaced radially extending ports 48 which open from the passage 44 to the smooth cylindrical exterior surface 46*a* of the closure member body portion 46. A relatively stout square cross section coil spring 50 is disposed in the bore 18 and is engageable with the shoulder 20 and with the closure member flange 45 to bias the closure member 42 in the valve closed position shown in FIG. 1. However, under the urging of pressure fluid acting on face 45*a* of the flange 45 the closure member 42 may be moved to a position wherein the ports 48 pass through the seal or packoff assembly 36 to provide for communication of fluid from the passage 44 into the bore 32.

Figure 3:
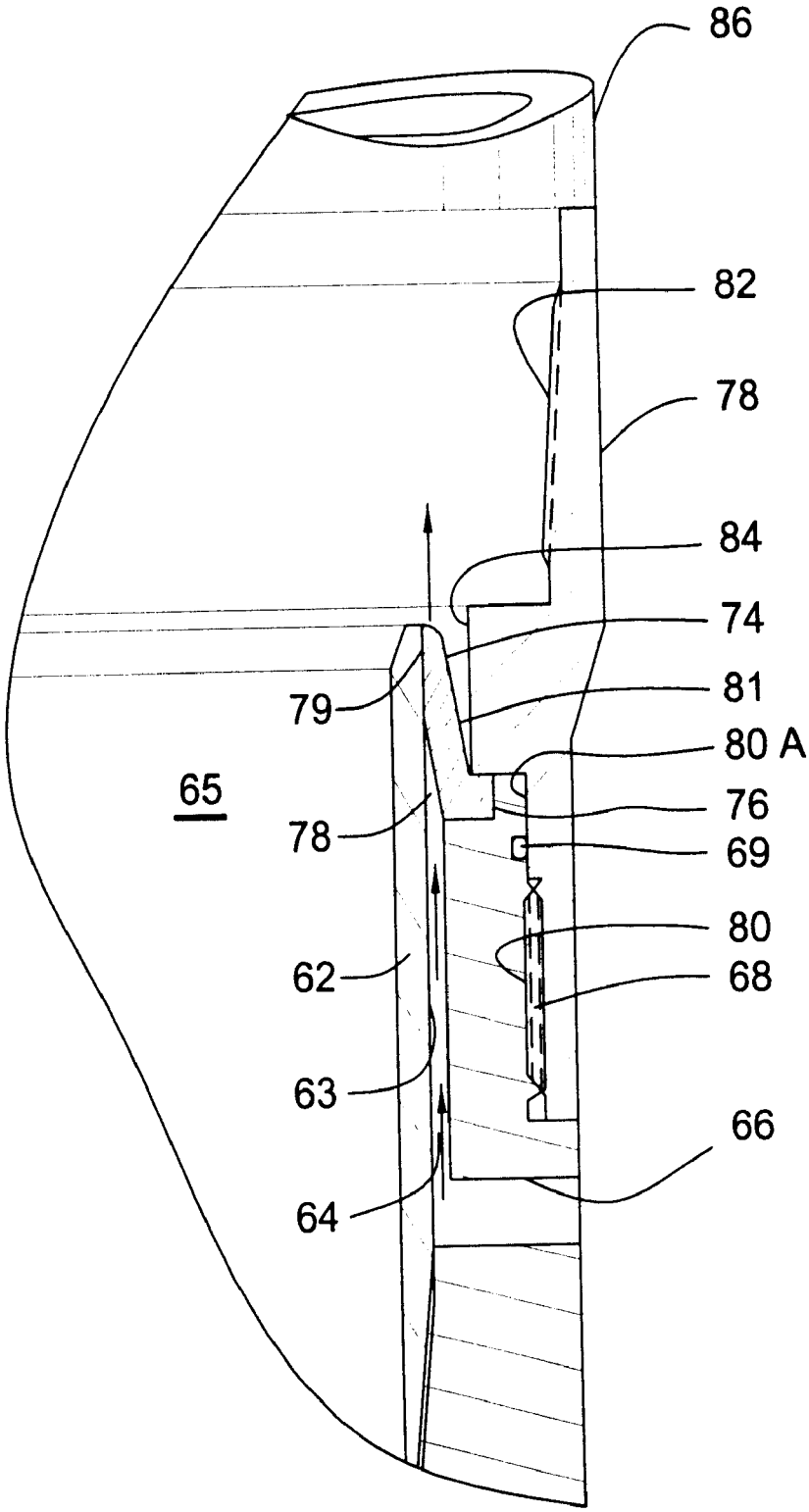
FIG. 3 is a detail section view of part of the flowback valve.

Referring further to FIGS. 1 and 2, the spring biased mudsaver valve just described is advantageously combined with a flowback valve which includes a cylindrical tubular body member 52 having internal threads 54 formed thereon and engageable with the threads 14 of the body member 12. An o-ring seal member 53, suitably disposed in a groove formed between threads 14 on member 12, engages a seal bore 54*a* on member 52. A transverse shoulder 56 on the body member 52 is engageable with the closure member 42 providing a stop for the closed position of the mudsaver valve. A stepped cylindrical bore 58, 59 is formed in the body member 52 to provide a through passage for flow of fluid into the passage 44 of the closure member 42. Bore 58 includes an internally threaded portion 60 for receiving an elongated cylindrical tubular sleeve 62 therein which is disposed in spaced relation to the bore 58 to provide an elongated annular passage 64, see FIG. 3 also, which passage is in fluid flow communication with plural circumferentially spaced radially extending ports 66 which open to the exterior of the body member 52.

The body member 52 includes a reduced diameter externally threaded part 68 which extends to an upper distal end 70 having an annular recess 72 formed therein and delimited by the bore 58. An annular flowback valve closure member 74, see FIG. 3 also, includes an enlarged diameter retaining flange 76 adapted to seat in the recess 72. The flowback valve closure member 74 has a generally frustoconical shape including an internal frustoconical surface 78, see FIG. 3, which extends from the flange 76 to a cylindrical seal portion 79 of the closure member which is engageable with the outer circumferential surface 63 of the sleeve 62. The flowback valve closure member 74 is preferably formed of an elastomeric material, such as nitrile rubber.

As shown in FIG. 1, the flowback valve closure member 74 is retained in the recess 72 by a generally cylindrical tubular adapter member 78 which is threadedly engaged with the body member 52 at cooperating threads 80 and 68. An o-ring seal 69 is disposed on body member 52 and engages a seal bore 80*a*, FIG. 3. An internal stepped bore 82, 84 opens to the upper distal end of the adapter 78 for receiving a fluid supply conduit 86 threadedly engaged with the adapter 78 for communicating pressure fluid, such as drilling mud, to the mudsaver valve and flowback valve assembly 10 described and shown.

The aforedescribed flowback valve including the annular or so-called "duckbill" closure member 74 is operable to equalize fluid pressure between conduit 86 and a casing or other member in which the valve assembly 10 is disposed. For example, when the valve assembly 10 is connected to fluid supply conduit 86 for conducting fluid through passage 65 in the member 62, into passage 44 and to act on the closure member 42 to bias the closure member to move axially downwardly, viewing FIG. 1, if the fluid pressure is sufficient the closure member 42 will move to a position wherein the ports 48 communicate with bore 32 and drilling or casing circulation fluid may be pumped into the upper end of a tubular casing, such as a casing section 90 shown in FIG. 4. The aforementioned drilling or circulation fluid is often, of necessity, laden with particulate material resulting from drilling operations, for example, or deliberately added to the fluid to increase its density and viscosity. The fluid may also include so-called lost circulation material mixed therein and adapted to plug voids in or a particularly porous type of earth formation.

However, with the configuration of the closure member 42 and the seal or packoff element assembly 36 arranged as shown and described, the mudsaver valve of the present invention is substantially less likely to fail to move properly between open and closed positions to conduct drilling fluid to a casing or the like, when desired, and to shutoff the flow of fluid from conduit 86 when the valve is desired to be closed and moved out of engagement with such casing, for example. Thanks to the configuration of the annular valve "seat" or packoff assembly 36, any particulate material that is flowing through the passage 44 and the ports 48, or is disposed in the bore 32, is wiped cleanly away from the outer substantially smooth circumferential surface 46*a*, FIG.

1, of the closure member 42 to prevent the closure member from being stuck in an open or closed position.

Another advantage of the mudsaver valve of the present invention resides in the ease with which the packoff assembly 36 may be removed and replaced. Merely by disengaging the guide nose 26 from the body member 42 the packoff assembly 36 may be replaced when desired. Moreover, by providing the hard metal wear sleeve 34 fluid flow impinging on this member, if causing erosion, will not destroy the more expensive body member or nose 26. Accordingly, the wear sleeve 34 may be easily replaced without requiring replacement of the nose 26.

If the valve assembly 10 is disposed in a casing section or other member through which fluid is flowing or in which fluid pressure is building, and the closure member 42 is in an open or a closed position, as shown in FIG. 1, the fluid pressure may be equalized between the aforementioned casing and the conduit 86 since fluid may flow through the ports 66, the annular passage 64 and elastically deform the closure member 74 to allow fluid to flow into bore 84 and back into the conduit 86 until pressure is substantially equalized as described. Fluid pressure acting on the frustoconical closure member surface 78, FIG. 3, will radially stretch or deflect the closure member 74 to allow passage of fluid from the annular passage 64 into the bore 84. Conversely, when pressure in the conduit 86 and bore 84 exceed that in the annular passage 64 and ports 66, the differential pressure forces acting between surfaces 78 and 81, see FIG. 3, will cause the closure member 74 to snuggly grip the outer surface 63 of the tube 62 to prevent fluid from conduit 86 bypassing the closure member 42.

Figure 4:
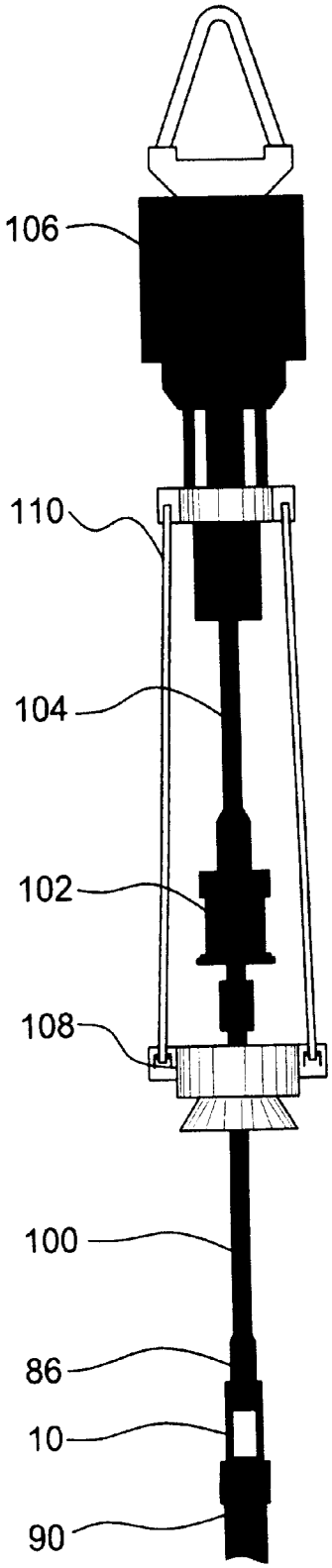
FIGS. 4, 5 and 6 are side elevation views showing a circulating head assembly and a mudsaver valve in accordance with the invention being inserted in a well casing section.
Figure 5:
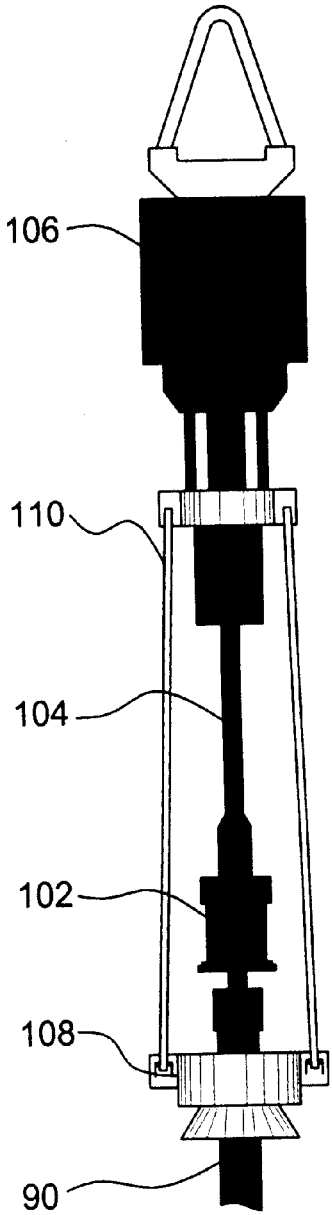
Figure 6:
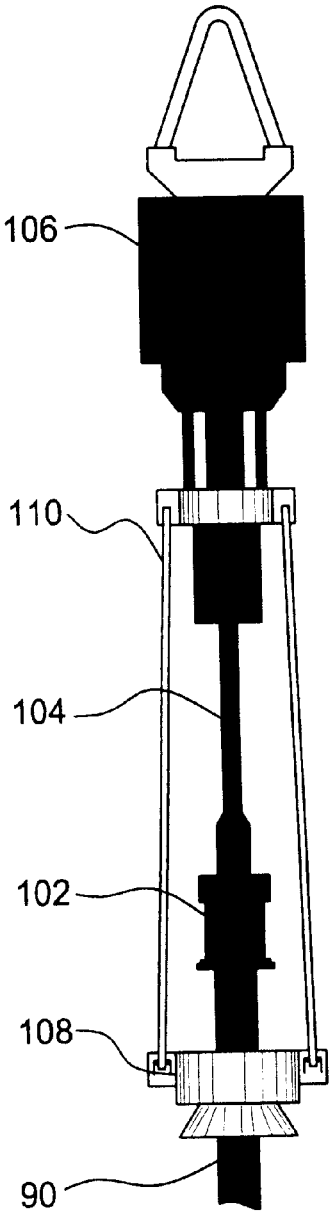

Referring now to FIGS. 4, 5 and 6, a typical operation of the mudsaver and flowback valve assembly 10 is illustrated, by way of example, showing the valve assembly 10 connected to the conduit 86 which, in turn, is connected to a flexible conduit section 100. Conduit section 100 is connected to a circulating head 102 and a conduit 104 suspended from a swivel or top drive assembly 106 of conventional construction and known to those skilled in the art of well drilling. Conventional casing elevators 108 are suspended from a bail assembly 110, also connected to the top drive assembly 106.

In a typical operation for setting casing in a well, a section of casing 90 is engaged by lowering the valve assembly 10 and conduits 86 and 100 into the interior of the casing until the elevators 108 are in a position to pickup the casing, as shown in FIG. 5. In this position the valve assembly 10 is disposed within the casing section 90 and the casing section may be picked up and placed in a position to be connected to a casing section, not shown, already set in a wellbore, not shown, unless the casing section 90 is the first section to be inserted. Once a casing section 90 is set in a position where it will not move freely the top drive or swivel assembly 106 is lowered until the circulating head 102 engages the top of the casing section to form a fluid tight seal therewith. The circulating head or coupling 102 may be of a type disclosed and claimed in U.S. Pat. Nos. 5,152,554; 5,282,653 or 5,348,351 to Karl K. LaFleur et al. and all assigned to the assignee of the present invention. Accordingly, when the circulating head or coupling member 102 is sealingly engaged with the top end of the casing section 90, as shown in FIG. 6, pressure fluid may be pumped down through the conduits 104, 100 and 86 and through the valve assembly 10 for purposes known to those skilled in the art. When it is desired to withdraw the valve assembly 10 from the casing section 90 pressure is automatically equalized between the interior of the casing section 90 and the conduits 86, 100 and 104, thanks to the flowback valve, including the annular closure member 74. In this way it may be determined whether or not excessive pressure exists in the casing and standpipe and pressure is equalized across closure member 42 allowing same to close.

Moreover, once pressure equalization reaches a point wherein the biasing spring 50 moves the closure member 42 to a valve closed position, any pressure differential remaining between the interior of the casing section 90 and the conduits 86, 100 and 104 is equalized by flow through the flowback valve. Of course, during casing setting operations or the like, when it is desired to circulate fluid through the interior of the casing, the mudsaver valve automatically moves to an open position when a suitable pressure differential exists across the closure member 42 to overcome the bias of the spring 50. Furthermore, the mudsaver valve substantially prevents drilling fluid from flowing out of the conduits 86, 100 and 104 when the valve assembly 10 has been withdrawn from the casing section 90.

The valve assembly 10 may be constructed using conventional engineering materials used for well drilling and related equipment and the construction and operation of the valve assembly 10 is believed to be understandable to those of ordinary skill in the art based on the foregoing description. Although a preferred embodiment of the invention has been described in detail herein those skilled in the art will also recognize that various substitutions and modifications may be made without departing from the scope and spirit of the appended claims.

What is claimed is:

1. A mudsaver valve for use in well operations to prevent spillage of wellbore circulation fluid from a conduit for conducting such fluid to a wellbore, said valve comprising:

an elongated tubular main body member;

an elongated, generally tubular mudsaver closure member disposed in said main body member, said mudsaver closure member including an elongated axially extending passage formed therein and passage means opening to an outer surface of said mudsaver closure member;

a biasing spring disposed in said main body member and engageable with said mudsaver closure member for biasing said mudsaver closure member in a valve closed position; and an annular packoff element adapted to remain stationary and be in substantially fluid tight sealing engagement with said mudsaver closure member whereby fluid flow through said mudsaver valve is prevented when said mudsaver closure member is in a first position and fluid may flow through said axially extending passage and said passage means when said mudsaver closure member is in a second position.

2. The valve set forth in claim 1 including:

a second body member removably securable to said main body member and including an axial bore formed therein for conducting fluid from said mudsaver closure member when said mudsaver closure member is in said second position.

3. The valve set forth in claim 2 wherein:

said packoff element is disposed in said second body member and is retained in sealing engagement with a surface of said mudsaver closure member when said body members are assembled to each other.

4. The valve set forth in claim 2 including:

a replaceable wear sleeve disposed in said bore formed in said second body member.

5. The valve set forth in claim 4 wherein:

said replaceable wear sleeve is adapted to support said packoff element in said bore in said second body member.

6. The valve set forth in claim 2 wherein:

said second body member includes an axially tapered nose part adapted to guide said mudsaver valve into the interior of a well conduit or the like.

7. The valve set forth in claim 1 wherein:

said packoff element comprises at least a first annular ring element formed of an elastomeric material and a second annular ring element formed of an elastomeric material, at least one of said ring elements being in sealing engagement with an exterior surface of said mudsaver closure member.

8. The valve set forth in claim 1 including:

a second body member connected to said main body member and including an axial bore extending substantially therethrough;

at least one port formed in said second body member and extending between the exterior of said second body member and passage means in said second body member; and a flow back closure member responsive to pressure fluid in said passage means to move to an open position to allow substantial fluid pressure equalization between a conduit connected to said valve and the exterior of said valve.

9. The valve set forth in claim 8 including:

a generally tubular adapter member releasably connected to said second body member and adapted to retain said flowback closure member supported on said second body member.

10. The valve set forth in claim 8 wherein:

said passage means in said second body member comprises an annular passage formed between a bore in said second body member and an elongated tubular sleeve supported in said second body member.

11. The valve set forth in claim 10 wherein:

said flowback closure member is engageable with said sleeve to form a closure over said annular passage.

12. The valve set forth in claim 11 wherein:

said flowback closure member comprises an elastomeric annular member including a substantially transverse annular flange part for retaining said flowback closure member in a working position supported on said second body member and a frustoconical closure part including a surface engageable with said sleeve to form a substantially fluid tight seal, and a pressure surface formed on said flowback closure member responsive to a fluid pressure differential sensed by said flowback closure member to deflect said flowback closure member to allow pressure fluid to flow from the exterior of said valve through said annular passage and into a conduit connected to said valve.

13. In a mudsaver valve for use in well operations, a main body member and a mudsaver closure member disposed in said main body member and engageable with means forming a valve seat;

a second body member connected to said main body member and including an axial bore extending substantially therethrough;

at least one port formed in said second body member and extending between the exterior of said second body member and passage means in said second body member; and a flowback closure member responsive to pressure fluid in said passage means to move to an open position to allow substantial fluid pressure equalization between a conduit connected to said valve and the exterior of said valve.

14. The valve set forth in claim 13 including:

a generally tubular adapter member releasably connected to said second body member and adapted to retain said flowback closure member supported on said second body member.

15. The valve set forth in claim 13 wherein:

said passage means in said second body member comprises an annular passage formed between a bore in said second body member and an elongated tubular sleeve supported in said second body member.

16. The valve set forth in claim 15 wherein:

said flowback closure member is engageable with said sleeve to form a closure over said annular passage.

17. The valve set forth in claim 16 wherein:

said flowback closure member comprises an elastomeric annular member including a substantially transverse annular flange part for retaining said flowback closure member in a working position supported on said second body member and a frustoconical closure part including a surface engageable with said sleeve to form a substantially fluid tight seal, and a pressure surface formed on said flowback closure member responsive to a fluid pressure differential sensed by said flowback closure member to deflect said flowback closure member to allow pressure fluid to flow from the exterior of said valve through said annular passage and into a conduit connected to said valve.

18. A mudsaver valve for use in well operations, comprising:

an elongated tubular main body member;

an elongated, generally tubular mudsaver closure member disposed in said main body member, said mudsaver closure member including an elongated axially extending passage formed therein and passage means opening to an outer surface of said mudsaver closure member;

a biasing spring disposed in said main body member and engageable with said mudsaver closure member for biasing said mudsaver closure member in a valve closed position;

an annular packoff element adapted to be in substantially fluid tight sealing engagement with said mudsaver closure member whereby said mudsaver closure member is movable relative to said packoff element between an open position for conducting fluid through said mudsaver closure member to the exterior of said valve and said packoff element between an open position for conducting fluid through said mudsaver closure member to the exterior of said valve and said closed position;

a second body member connected to said main body member and including an axial bore extending substantially therethrough;

an elongated sleeve disposed in said bore in said second body member and forming an annular passage therewith;

at least one port formed in said second body member and extending between the exterior of said second body member and said annular passage; and a flowback closure member responsive to pressure fluid in said annular passage to move to an open position to allow substantial fluid pressure equalization between a conduit connected to said valve and the exterior of said valve.

19. The valve set forth in claim 18 including:

a generally tubular adapter member releasably connected to said second body member and adapted to retain said flowback closure member supported on said second body member.

20. The valve set forth in claim 19 wherein:

said flowback closure member comprises an elastomeric annular member including a substantially transverse annular flange part for retaining said flowback closure member in a working position supported on said second body member and a frustoconical closure part including a surface engageable with said sleeve to form a substantially fluid tight seal, and a pressure surface formed on said flowback closure member responsive to a fluid pressure differential sensed by said flowback closure member to deflect said flowback closure member to allow pressure fluid to flow from the exterior of said valve through said annular passage and into a conduit connected to said valve.

21. A mudsaver valve for use in well operations to prevent spillage of wellbore circulation fluid from a conduit for conducting such fluid to a wellbore, said valve comprising:

an elongated tubular main body member;

an elongated, generally tubular mudsaver closure member disposed in said main body member, said mudsaver closure member including an elongated axially extending passage formed therein and passage means opening to an outer surface of said mudsaver closure member;

a biasing spring disposed in said main body member and engageable with said mudsaver closure member for biasing said mudsaver closure member in a valve closed position;

an annular packoff element adapted to be in substantially fluid tight sealing engagement with said mudsaver closure member whereby fluid flow through said mudsaver valve is prevented when said mudsaver closure member is in a first position and fluid may flow through said axially extending passage and said passage means when said mudsaver closure member is in a second position; and a second body member removably securable to said main body member and including an axial bore formed therein for conducting fluid from said mudsaver closure member when said mudsaver closure member is in said second position, said packoff element disposed in said second body member and retained in sealing engagement with a surface of said mudsaver closure member when said body members are assembled to each other.

22. A mudsaver valve for use in well operations to prevent spillage of wellbore circulation fluid from a conduit for conducting such fluid to a wellbore, said valve comprising:

an elongated tubular main body member;

an elongated, generally tubular mudsaver closure member disposed in said main body member, said mudsaver closure member including an elongated axially extending passage formed therein and passage means opening to an outer surface of said mudsaver closure member;

a biasing spring disposed in said main body member and engageable with said mudsaver closure member for biasing said mudsaver closure member in a valve closed position;

an annular packoff element adapted to be in substantially fluid tight sealing engagement with said mudsaver closure member whereby fluid flow through said mudsaver valve is prevented when said mudsaver closure member is in a first position and fluid may flow through said axially extending passage and said passage means when said mudsaver closure member is in a second position;

a second body member removably securable to said main body member and including an axial bore formed therein for conducting fluid from said mudsaver closure member when said mudsaver closure member is in said second position; and a replaceable wear sleeve disposed in said bore formed in said second body member, said replaceable wear sleeve adapted to support said packoff element in said bore in said second body member.

23. A mudsaver valve for use in well operations to prevent spillage of wellbore circulation fluid from a conduit for conducting such fluid to a wellbore, said valve comprising:

an elongated tubular main body member;

an elongated, generally tubular mudsaver closure member disposed in said main body member, said mudsaver closure member including an elongated axially extending passage formed therein and passage means opening to an outer surface of said mudsaver closure member;

a biasing spring disposed in said main body member and engageable with said mudsaver closure member for biasing said mudsaver closure member in a valve closed position;

an annular packoff element adapted to be in substantially fluid tight sealing engagement with said mudsaver closure member whereby fluid flow through said mudsaver valve is prevented when said mudsaver closure member is in a first position and fluid may flow through said axially extending passage and said passage means when said mudsaver closure member is in a second position; and a second body member removably securable to said main body member and including an axial bore formed therein for conducting fluid from said mudsaver closure member when said mudsaver closure member is in said second position, said second body member includes an axially tapered nose part adapted to guide said mudsaver valve into the interior of a well conduit or the like.

24. A mudsaver valve for use in well operations to prevent spillage of wellbore circulation fluid from a conduit for conducting such fluid to a wellbore, said valve comprising:

an elongated tubular main body member;

an elongated, generally tubular mudsaver closure member disposed in said main body member, said mudsaver closure member including an elongated axially extending passage formed therein and passage means opening to an outer surface of said mudsaver closure member;

a biasing spring disposed in said main body member and engageable with said mudsaver closure member for biasing said mudsaver closure member in a valve closed position;

an annular packoff element adapted to be in substantially fluid tight sealing engagement with said mudsaver closure member whereby fluid flow through said mudsaver valve is prevented when said mudsaver closure member is in a first position and fluid may flow through said axially extending passage and said passage means when said mudsaver closure member is in a second position;

a second body member connected to said main body member and including an axial bore extending substantially therethrough;

at least one port formed in said second body member and extending between the exterior of said second body member and passage means in said second body member; and a flow back closure member responsive to pressure fluid in said passage means to move to an open position to allow substantial fluid pressure equalization between a conduit connected to said valve and the exterior of said valve.

25. The valve set forth in claim 24, further comprising:

a generally tubular adapter member releasably connected to said second body member and adapted to retain said flowback closure member supported on said second body member.

26. The valve set forth in claim 24, wherein said passage means in said second body member comprises an annular passage formed between a bore in said second body member and an elongated tubular sleeve supported in said second body member.

27. The valve set forth in claim 26, wherein said flowback closure member is engageable with said sleeve to form a closure over said annular passage.

28. The valve set forth in claim 27, wherein said flowback closure member comprises an elastomeric annular member including a substantially transverse annular flange part for retaining said flowback closure member in a working position supported on said second body member and a frustoconical closure part including a surface engageable with said sleeve to form a substantially fluid tight seal, and a pressure surface formed on said flowback closure member responsive to a fluid pressure differential sensed by said flowback closure member to deflect said flowback closure member to allow pressure fluid to flow from the exterior of said valve through said annular passage and into a conduit connected to said valve.

29. In a mudsaver valve for use in well operations, a main body member and a mudsaver closure member disposed in said main body member and engageable with means forming a valve seat;

a second body member connected to said main body member and including an axial bore extending substantially therethrough;

at least one port formed in said second body member and extending between the exterior of said second body member and passage means in said second body member; and a flowback closure member responsive to pressure fluid in said passage means to move to an open position to allow substantial fluid pressure equalization between a conduit connected to said valve and the exterior of said valve, said passage means in said second body member comprises an annular passage formed between a bore in said second body member and an elongated tubular sleeve supported in said second body member.

* * * * *